United States Patent [19]

Guelden

[11] 4,349,236

[45] Sep. 14, 1982

[54] WEATHERPROOF ELECTRICAL JACK ASSEMBLY

[75] Inventor: Ronald H. Guelden, Shreveport, La.

[73] Assignee: Bell Telephone Laboratories, Incorporated, Murray Hill, N.J.

[21] Appl. No.: 194,424

[22] Filed: Oct. 6, 1980

[51] Int. Cl.[3] ..... H01R 13/52

[52] U.S. Cl. ..... 339/44 M; 339/94 M

[58] Field of Search ..... 339/44, 89 R, 89 M, 339/94 R, 94 M

[56] References Cited

U.S. PATENT DOCUMENTS

| | | | |
|---|---|---|---|
| 3,153,118 | 10/1964 | Clark | 174/48 |
| 4,040,699 | 8/1977 | Rasmussen | 339/91 R |
| 4,076,360 | 2/1978 | Kahera | 339/36 |
| 4,138,187 | 2/1979 | Brygger | 339/117 R |
| 4,188,082 | 2/1980 | Dickey | 339/36 |
| 4,245,875 | 1/1981 | Shaffer | 339/44 M |

*Primary Examiner*—Joseph H. McGlynn
*Attorney, Agent, or Firm*—W. H. Kamstra

[57] ABSTRACT

An electrical jack assembly for a modular telephone (10) utilizing the combination of a grommet (36), washer (38), and cap (40) to seal the jack opening (30) when a modular telephone cord plug (12) is inserted. The washer (38) includes a pair of projections (86, 88) which pass through slots (64, 66) in the grommet and enter slots (32, 34) within the jack frame (26), whereby the washer (38) and grommet (36) are keyed and prevented from turning. The cap (40) fits over the washer (38) and grommet (36) and couples with a threaded sleeve (28) on the jack frame (26).

5 Claims, 5 Drawing Figures

WEATHERPROOF ELECTRICAL JACK ASSEMBLY

TECHNICAL FIELD

This invention relates to electrical jack assemblies and particularly to such assemblies adapted to be sealed from the environment.

BACKGROUND OF THE INVENTION

The trend in modern telephone technology is toward the "modular apparatus" concept. Telephone handsets, cords, and modular plugs and jacks are easily plugged into one another to provide electrical connection to a telephone transmission conductor pair. In certain applications, a wall jack may be mounted either outdoors or in a severe indoor environment. Under these circumstances, it is desirable to seal the jack opening.

Gasketed lift cover assemblies are typically used to protect electrical jack openings. The lift cover is normally biased to a closed position by a coil spring. These assemblies work effectively with the lift cover closed. However, with the lift cover raised, only very limited protection is provided. For example, the cover only shields the jack opening from liquids issuing from above the jack.

Various and numerous assemblies which provide a sealed electrical jack opening when a plug is inserted are known in the art, one being disclosed, for example, in U.S. Pat. No. 4,138,187, of F. Brygger, issued Feb. 6, 1979. When considered from the standpoints of utility and manufacturability, for example, many such assemblies are less than desirable for specific application with modular telephone plugs and cords. The chief object of this invention is thus to provide a new and novel sealed jack assembly wherein the sealing means can be readily mounted around a standard mounting cord by a customer or craftsperson.

SUMMARY OF THE INVENTION

The aforementioned objective is advantageously realized and a technical advance is achieved in accordance with the principles of the invention in an electrical jack assembly adapted to receive a modular telephone plug and cord comprising a jack frame having an externally threaded cylindrical sleeve and a grommet, washer, and cap which encircle the cord and seal the plug and the jack opening. The washer includes a pair of projections which pass through slots in the grommet and enter slots within the jack frame, whereby the washer and grommet are keyed and prevented from turning. The cap fits over the washer and grommet and couples with the threaded sleeve. In one embodiment of the invention, the grommet is flexible and is compressed around the cord to seal the opening when the cap is screwed on the sleeve. The grommet has a radial split to facilitate mounting on the cord. The threaded sleeve on the jack frame is terminated in a chamfered surface upon which the grommet means may be seated. An additional feature is a gasketed, spring-loaded lift cover assembly which seals the jack opening when the cover is closed over the sleeve.

BRIEF DESCRIPTION OF THE DRAWING

The features and advantages of an electrical jack assembly according to the principles of this invention will be better understood from a consideration of the detailed description of the organization and operation of one illustrative embodiment thereof which follows when taken in conjunction with the accompanying drawing in which.

DETAILED DESCRIPTION

Figure 1:
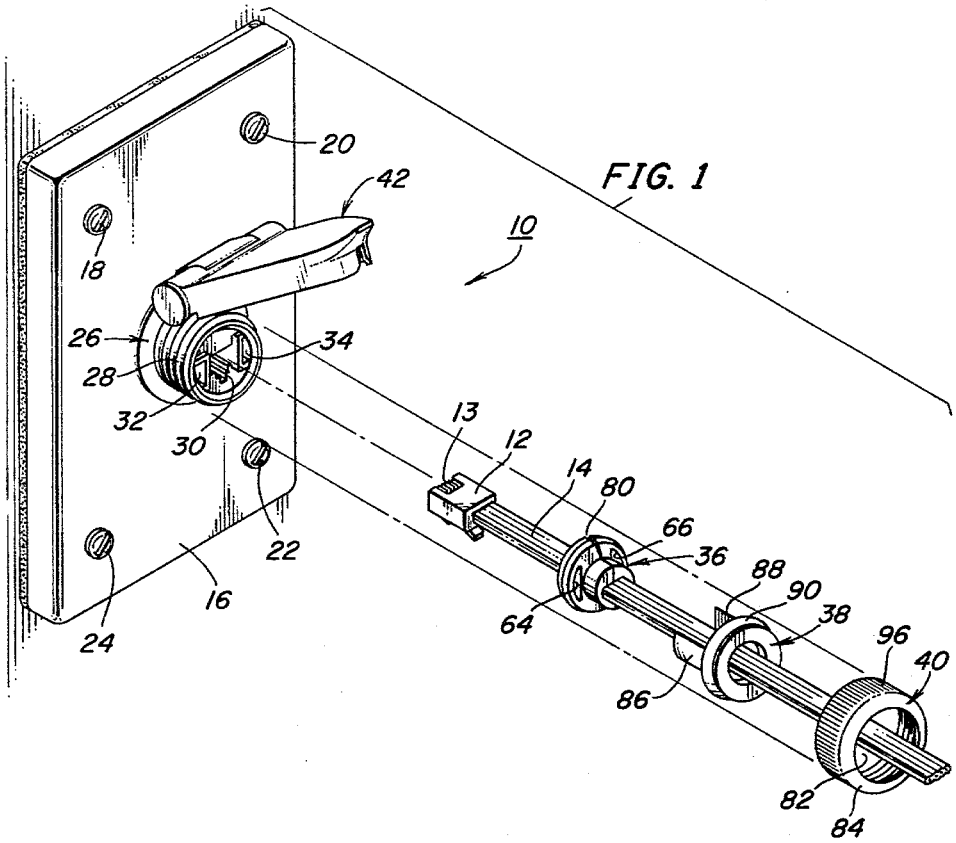
FIG. 1 is a perspective view of the jack assembly with the lift cover open and the grommet, washer, and cap encircling the cord in their position preparatory to use.

In FIG. 1 an exemplary electrical jack assembly 10 is depicted in perspective view, the various operative components being shown in their positions preparatory to use. Jack assembly 10, adapted to receive a modular telephone plug 12 and cord 14, is ultrasonically bonded to a molded faceplate 16 which may, in turn, be mounted on a wall outlet box (not shown), for example, using the mounting screws 18, 20, 22, and 24. A jack frame 26 has an externally threaded cylindrical sleeve 28 which defines within a substantially rectangular jack opening 30 and a pair of slots 32 and 34 positioned on opposite sides of opening 30.

When the jack is in use, jack opening 30 and plug 12 are sealed from the environment by the combined action of a grommet 36, washer 38, and cap 40, to be described. When the jack is not in use, protection is provided by a lift cover assembly 42.

Figure 2:
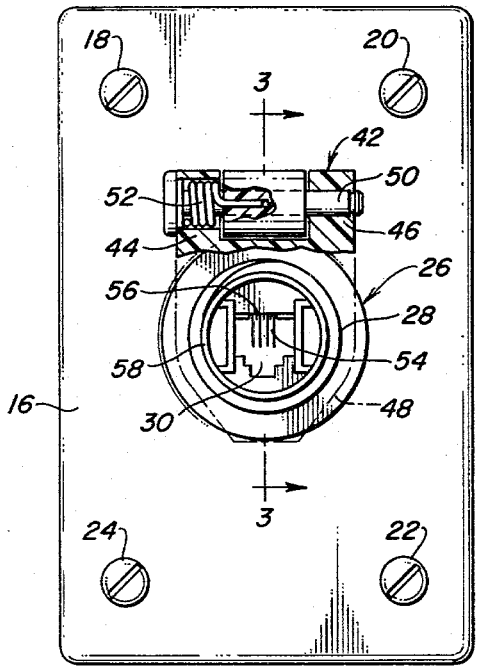
FIG. 2 is a front view of the unoccupied jack assembly with the lft cover partially sectioned to show the features within the jack frame.
Figure 3:
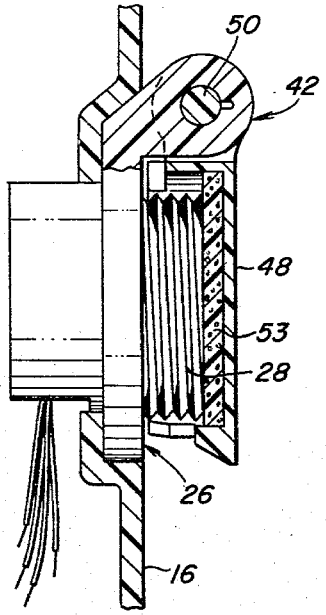
FIG. 3 is a cross-section, enlarged side view of the assembly of FIG. 2 taken along the line 3—3.

As shown in FIG. 2, a pair of laterally spaced apart legs 44 and 46 of a cover 48 are journaled for pivotal movement on a horizontal pin 50. A coil spring 52 is mounted on pin 50 to bias the lower and free end of cover 48 downwardly to the closed position. This type of spring-biased cover mounting is conventional and, therefore, further description is not needed. As shown in FIG. 3, a circular gasket 53 within cover 48 is pressed against sleeve 28 when cover assembly 42 is closed.

Figure 4:
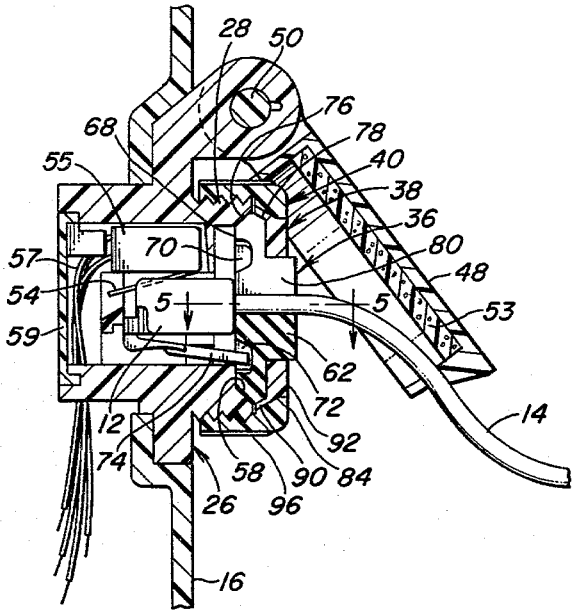
FIG. 4 is a cross-section, enlarged side view of the occupied jack assembly showing the grommet, washer, and cap in position to seal the jack opening.

When inserted into jack opening 30, the contacts 13 of modular plug 12 achieve electrical communication with the spring contacts 54 of a dielectric carrier 55, spring contacts 54 fitting within the grooves 56 which are located within jack opening 30 to the rear of faceplate 16. As shown in FIG. 4, the conductors 57 of dielectric carrier 55 are sealed by a rear cover 59 which may be ultrasonically bonded to jack frame 26. Jack opening 30 is adapted to receive modular telephone plug 12. Such a plug and how it coacts with spring contacts are well known in the art and are disclosed, for example, in U.S. Pat. No. 4,040,699 of H. R. Rasmussen, issued Aug. 9, 1977, to which reference may be had for further details. Sleeve 28 extends forward beyond jack opening 30 and terminates in an inwardly chamfered surface 58.

Figure 5:
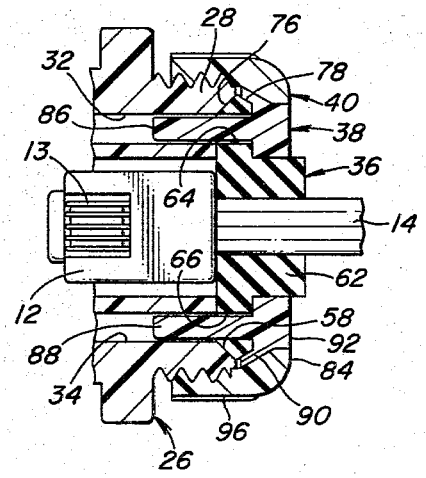
FIG. 5 is a cross-section top view of the assembly of FIG. 4 taken along the line 5—5.

FIGS. 4 and 5 show the relationship between grommet 36, washer 38, and cap 40 as assembled to seal modular plug 12 and jack opening 30 when the jack is occupied. In the embodiment shown, grommet 36 is a flexible member molded of an impervious, elastomeric material, such as rubber. Grommet 36 has a neck 62 extending frontwardly and fitting closely around cord 14. A pair of slots 64 and 66 corresponding, respectively, to slots 32 and 34 within jack frame 26 are positioned adjacent to and on opposite sides of neck 62. A rear surface 68 of grommet 36 has a pair of indentations 70 and 72, one of which is used to seat a latch 74 of modular plug 12 as grommet 36 is pressed into place. (A pair of indentations is provided to allow the grommet to be mounted in either of two positions differing by approximately 180 degrees of rotation.) Grommet 36 has a rear beveled edge 76 setting upon chamfered surface 58 of sleeve 28 and a front beveled edge 78 fitting within washer 38. A radial split 80 is made in grommet 36 to allow easy assembly around cord 14.

Grommet 36 is urged into sealing contact with sleeve 28 and cord 14 by the combined action of washer 38 and cap 40. Both the inside diameter of washer 38 and the diameter of a hole 82 in a front surface 84 of cap 40 are large enough to permit modular plug 12 to be passed through, thereby allowing washer 38 and cap 40 to be easily mounted on cord 14. Washer 38 includes a pair of projections 86 and 88 which pass through slots 64 and 66 in grommet 36 and enter slots 32 and 34 within jack frame 26, whereby washer 38 and grommet 36 are keyed and prevented from turning.

Washer 38 has an outwardly flared flange 90 which fits over front beveled edge 78 of grommet 36. Neck 62 of grommet 36 fits closely within and extends through washer 38. Cap 40 is internally threaded to couple with sleeve 28 on jack frame 26 and is adapted to receive washer 38 such that a front surface 92 of washer 38 is flush with front surface 84 of cap 40. An outer surface 96 of cap 40 is knurled to aid gripping. Tightening of cap 40 will squeeze grommet 36 around cord 14 as grommet 36 seats on chamfered surface 58 of sleeve 28.

What has been described is considered to be only one specific illustrative electrical jack assembly according to the invention and it is to be understood that various and numerous other assemblies may be devised by one skilled in the art without departing from the spirit and scope thereof as defined by the accompanying drawings.

What is claimed is:

1. An electrical jack assembly (10) adapted to receive a modular telephone plug (12) and cord (14) characterized in a jack frame (26) having an externally threaded cylindrical sleeve (28) internally defining a substantially rectangular jack opening (30), said sleeve (28) also having at least one slot (32) positioned on one side of said opening (30);

a grommet means (36) for sealing said jack opening (30) when said modular plug (12) and cord (14) is inserted, said grommet means (36) seating on the end of said sleeve (28) and having a slot (64) corresponding to said slot (32) within said jack frame (26);

a washer (38) adapted to encircle said cord (14), and washer (38) including a projection (86) arranged and dimensioned to permit entry through said slot (64) of said grommet means (36) and said slot (32) of said jack frame (26); and a cap (40) adapted to encircle said cord (14) and internally threaded to fit said externally threaded sleeve (28), said cap (40) fitting over said washer (38) and grommet means (36) when said cap (40) is screwed on said sleeve (28).

2. An electrical jack assembly (10) as claimed in claim 1 further characterized in that said grommet means (36) is compressible.

3. An electrical jack assembly (10) as claimed in claim 2 further characterized in that said grommet means (36) has a radial split (80).

4. An electrical jack assembly (10) as claimed in claim 1, 2, or 3 further characterized in a spring-loaded lift cover assembly (42) over said threaded sleeve (28) on said jack frame (26) and in a gasket (53) pressed against said sleeve (28) when said cover assembly (42) is closed.

5. An electrical jack assembly adapted to receive a modular telephone plug and cord comprising:

a jack frame having an externally threaded cylindrical sleeve internally defining a substantially rectangular jack opening, said sleeve also having a pair of slots positioned on opposite sides of said opening;

a grommet means for sealing said jack opening when said modular plug and cord is inserted, said grommet means seating on the end of said sleeve and having a pair of slots corresponding to said slots within said jack frame;

a washed adapted to encircle said cord, said washer including a pair of projections arranged and dimensioned to permit entry through said slots of said grommet means and said slots of said jack frame; and a cap adapted to encircle said cord and internally threaded to fit said externally threaded sleeve, said cap fitting over said washer and grommet means when said cap is screwed on said sleeve.

* * * * *

UNITED STATES PATENT AND TRADEMARK OFFICE

CERTIFICATE OF CORRECTION

PATENT NO. : 4,349,236

DATED : September 14, 1982

INVENTOR(S) : Ronald H. Guelden

It is certified that error appears in the above—identified patent and that said Letters Patent is hereby corrected as shown below:

In the claims, Column 4, line 9, after "(14)," delete "and" and insert --said--.

Signed and Sealed this

Twenty-ninth Day of March 1983

[SEAL]

Attest:

GERALD J. MOSSINGHOFF

Attesting Officer

Commissioner of Patents and Trademarks